United States Patent [19]

Bessyo et al.

[11] Patent Number: 4,851,629

[45] Date of Patent: Jul. 25, 1989

[54] HIGH-FREQUENCY HEATING DEVICE

[75] Inventors: Daisuke Bessyo; Naoyoshi Maehara, both of Nara; Kazuho Sakamoto, Kyoto; Shigeru Kusunoki; Takahiro Matsumoto, both of Nara, all of Japan

[73] Assignee: Matsushita Electric Industrial Co., Ltd., Kadoma, Japan

[21] Appl. No.: 208,490

[22] Filed: Jun. 20, 1988

[51] Int. Cl.[4] ..... H01J 25/50

[52] U.S. Cl. ..... 219/10.55 B; 315/39.51; 336/221

[58] Field of Search ..... 219/10.55 B; 315/39.51, 315/39.53; 331/86; 336/234, 221, 110, 179; 361/270

[56] References Cited

U.S. PATENT DOCUMENTS

| | | | |
|---|---|---|---|
| 3,846,667 | 11/1974 | Hisada | 315/39.53 |
| 4,131,824 | 12/1978 | Nakai et al. | 315/39.51 |
| 4,419,606 | 12/1983 | Tsuzurabara | 315/39.51 |

*Primary Examiner*—A. D. Pellinen
*Assistant Examiner*—Leon K. Fuller
*Attorney, Agent, or Firm*—Wenderoth, Lind & Ponack

[57] ABSTRACT

In a high-frequency heating device for driving a magnetron at a high frequency between 20 and 50 KHz, the magnetron is provided with a plurality of choke coils, each of which consists of a magnetic core having a sectional area between 40 to 70 mm$^2$ and an electric wire wound around the magnetic core and having a diameter between 1.2 and 1.6 mm. In such a construction, the magnetron can be driven, using the high frequency with reduced thermal loss of the choke coil and restrained heat generation.

2 Claims, 4 Drawing Sheets

HIGH-FREQUENCY HEATING DEVICE

BACKGROUND OF THE INVENTION

1. Field of the Invention

The present invention generally relates to a heating device, and more particularly, to a high-frequency heating device for driving a magnetron, using the high frequency between 20 and about 50 KHz.

2. Description of the Prior Art

Recently, various kinds of high-frequency heating devices are proposed for the tendency towards miniaturization, lightweight, cost reduction or the like of a power transformer provided in each device.

A typical circuit diagram of the high-frequency heating device is generally shown in FIG. 1*a*. In the circuit of FIG. 1*a*, electric power produced by a commercial power source 1 is rectified by a diode bridge 2 to form a unilateral power source. An inductor 3 and a capacitor 4 play in cooperation with each other a role as a filter with respect to the high-frequency switching operation of an inverter, which is comprised of a resonance capacitor 5, a step-up transformer 6, a transistor 7, a diode 8 and a driving circuit 9. The transformer 6 is provided with three windings, the first, second and third windings 10, 11 and 12.

Base current supplied from the driving circuit 9 causes the transistor 7 to perform the switching operation in a predetermined period and duty (the ratio of "on" period with respect to the cycle period). As a result, collector current Ic of the transistor 7 and current of the diode 8 flow as shown in FIG. 1*b*. On the other hand, when the transistor 7 is off, resonance between the capacitor 5 and the first winding 10 of the transformer 6 generates voltage Vce between a collector and an emitter of the transistor 7, as shown in FIG. 1*c*. Because of this, high-frequency electric power is generated in the first winding 10.

In the transformer 6, high-frequency high-voltage power and high-frequency low-voltage power are generated in the second winding 11 and the third winding 12, respectively. More specifically, the high-frequency high-voltage power is rectified by a capacitor 37 and a diode 38 to be supplied between an anode and a cathode of a magnetron 15 whereas the high-frequency low-voltage power is supplied to a cathode heater of the magnetron 15. Accordingly, the magnetron 15 oscillates to effect dielectric heating. The magnetron 15 is comprised of the magnetron body 15*a* and a filter for preventing undesirable radiation towards outside space through heater electrodes of the magnetron body 15*a*. The filter is comprised of feed-through capacitors 16, 17, 18 and choke coils 19, 20, with the feed-through capacitors 16, 17 and 18 being integrally formed with one another.

In the high-frequency heating device of the above described construction, the sectional area of a core of the step-up transformer 6 can be reduced with the increase of frequency of the power applied between opposite ends of the first winding 10. Therefore, for example, when the inverter is operated with the use of the frequency between 20 and approximately 50 KHz, the weight and size of the step-up transformer 6 can be reduced to a half or less, or to a tenth or less as compared with the case where the step-up is done using the frequency of the commercial power source as it is. This is advantageous in that the power source portion can be manufactured at reduced cost.

The high-frequency heating device employing therein audio frequency below 20 KHz is not serviceable due to undesirable sound generated primarily by the step-up transformer 6.

FIGS. 2*a* and 2*b* depict the structure of the aforementioned filter provided in the magnetron 15.

As shown in FIGS. 2*a* and 2*b*, the choke coils 19, 20 are accommodated in a filter box 36 of the magnetron 15, and the integrally formed feed-through capacitors 16, 17 and 18 extend through the filter box 36. In the conventional magnetron, electric wires forming the choke coils 19 and 20 have a diameter between 1.4 and 1.6 mm whereas rod-shaped magnetic cores 32 and 33 are made of ferrite having a diameter of 5 mm and a length of 21 mm. The electric wires 30 and 31 are densely wound substantially around the central portion of respective rod-shaped magnetic cores 32 and 33. Each of the electric wires 30 and 31 of respective choke coils 19 and 20 is connected at its one end to one heater electrode 34 of the magnetron body 15*a* and at its other end to one electrode 35 of the feed-through capacitors 16, 17 and 18.

In the case where the magnetron 15 having the structure of the choke coils 19 and 20 and driven normally with the use of the commercial frequency is driven using the frequency between 20 and 50 KHz much higher than the commercial frequency, the electric wires 30 and 31 of the choke coils 19 and 20 and the magnetic cores 32 and 33 generate heat due to the increase of copper loss caused by skin effect and the increase of core loss, for example, eddy current loss, hysteresis loss or the like.

When the magnetic cores 32 and 33 of ferrite exceed the Curie point in temperature, the permeability of the ferrite rapidly decreases, thus resulting in that the choke coils 19 and 20 can not function as a filter due to the reduction of their inductances. Furthermore, the choke coils 19 and 20 can hardly restrain the electric current flowing in the heater of the magnetron 15 which has been so far restrained thereby, also due to the reduction of their inductances. Accordingly, an excessive current flows through the heater of the magnetron 15 and remarkably shortens its life. In addition, heat generated in the choke coils 19 and 20 raises the temperature of the feed-through capacitors 16, 17 and 18 through the electrodes 35 of these capacitors 16, 17 and 18. Generally speaking, the life of the feed-through capacitor is nearly halved with the temperature rise of approximately 10° C. The kind of insulation of the electric wires 30 and 31 used in the choke coils 19 and 20 is a grade H having the maximum allowable temperature of 180° C. The choke coils 19 and 20 are, therefore, required to be used below this maximum allowable temperature.

SUMMARY OF THE INVENTION

Accordingly, the present invention has been developed with a view to substantially eliminating the above described disadvantages inherent in the prior art high-frequency heating device, and has for its essential object to provide an improved high-frequency heating device in which undesirable heat generated in choke coils of a magnetron can be restrained as small as possible on condition that each choke coil keeps a certain inductance required as a filter.

Another important object of the present invention is to provide a high-frequency heating device of the above described type which is simple in construction and stable in functioning, and can be readily manufactured at a low cost.

In accomplishing these and other objects, a high-frequency heating device according to one preferred embodiment of the present invention is provided with a magnetron having therein a plurality of choke coils, each of which consists of a rod-shaped magnetic core of ferrite having a sectional area between 40 and 70 $mm^2$ and an electric wire having a diameter between 1.2 and 1.6 mm. By such an optimized construction, heat generated in the choke coils can be restrained as small as possible in the case where the magnetron is driven using the high-frequency between 20 and 50 KHz.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals and wherein.

DETAILED DESCRIPTION OF THE PREFERRED EMBODIMENTS

Figure 1A:
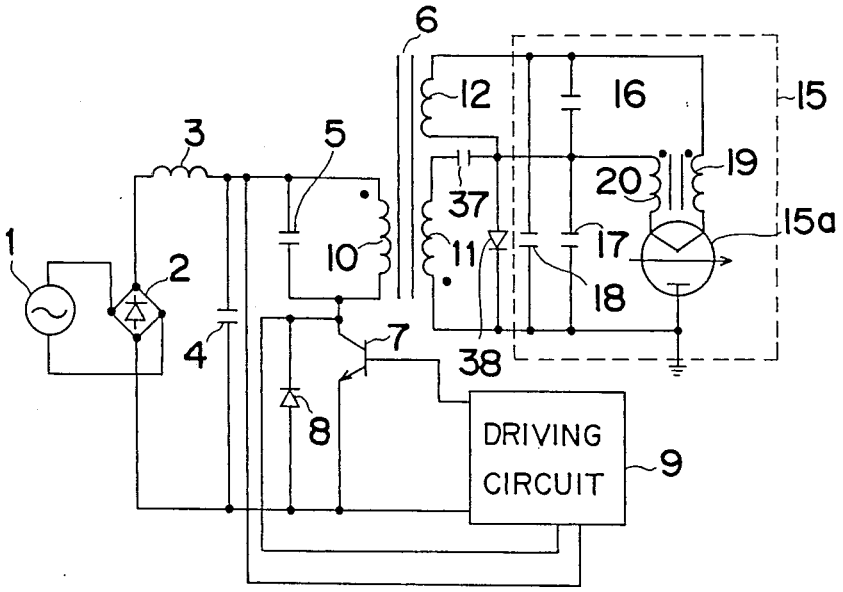
Fig. 1a PRIOR ART
FIG. 1*a* is a circuit diagram generally employed in a high-frequency heating device.
Figure 1B:
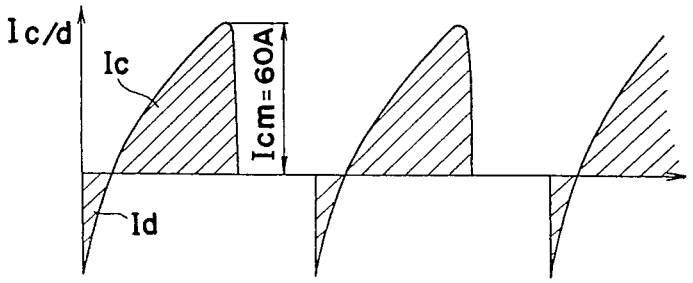
FIG. 1*b* is a graph showing an electric current flowing in a collector of a transistor and another electric current flowing in a diode in the circuit of FIG. 1*a;*
Figure 1C:
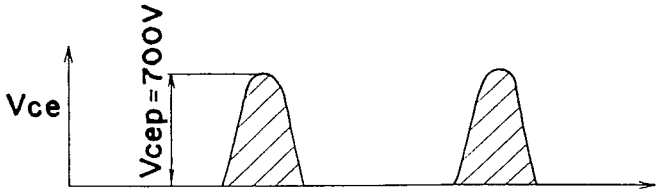
FIG. 1*c* is a graph showing an electric voltage produced between a cathode and an emitter of the transistor in the circuit of FIG. 1*a;*

As shown in FIG. 1*a,* a high-frequency heating device is generally provided with a magnetron 15 comprised of a magnetron body 15*a* and a magnetron filter for prevention of undesirable radiation through heater electrodes of the magnetron body 15*a.*

The high-frequency heating device of the present invention is primarily different from the conventional one in the diameter of rod-shaped magnetic cores of ferrite.

Figure 2A:
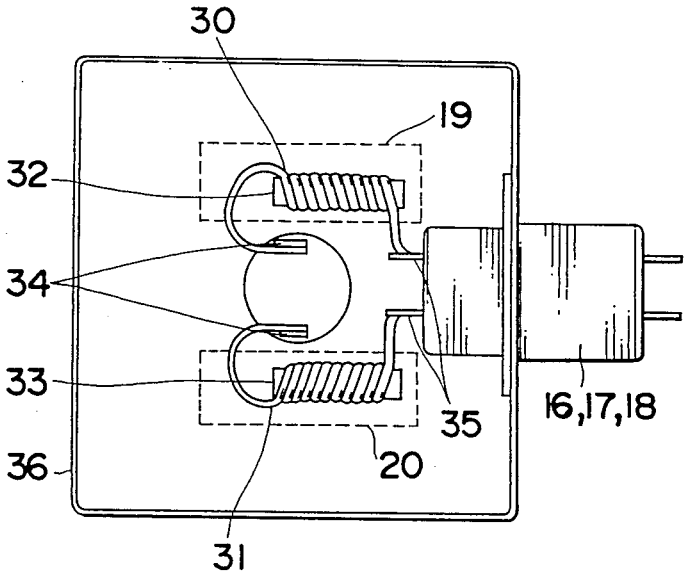
FIG. 2*a* is an elevational view of a filter box of a magnetron employed in the circuit of FIG. 1*a;*
Figure 2B:
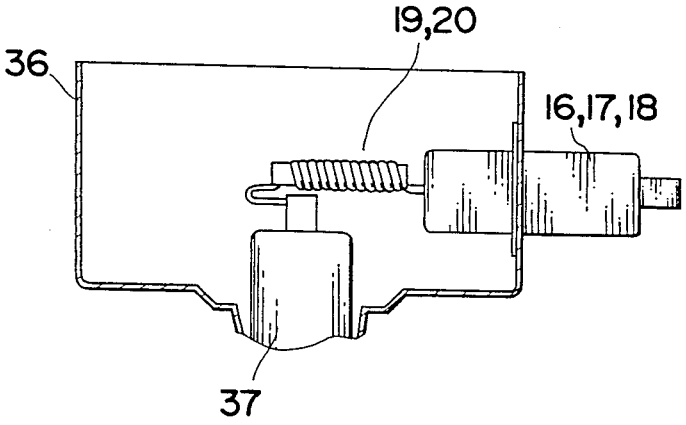
FIG. 2*b* is a sectional view of the filter box of FIG. 2*a;*

Referring to FIGS. 2*a* and 2*b,* the magnetron filter is comprised of two choke coils 19 and 20 and three integrally formed feed-through capacitors 16, 17 and 18. Each of the choke coils 19 and 20 consists of a magnetic core 32 or 33 of ferrite having a diameter of 7 to 10 mm and a winding 30 or 31 of an electric wire having a diameter of 1.2 to 1.6 mm wound around the magnetic core 32 or 33. Each of the electric wires 30 and 31 of respective choke coils 19 and 20 is connected at its one end to one electrode 35 of the feed-through capacitors 16, 17 and 18 and at its other end to one heater electrode 34 of the magnetron. The choke coils 19 and 20 are accommodated in a filter box 36 whereas the feed-through capacitors 16, 17 and 18 extend through the filter box 36. The heater electrodes 34 are thermally insulated from the filter box 36 by virtue of an insulation glass or porcelain 37. The filter box 36 and the insulation glass 37 also comprise a part of the magnetron.

Figure 3:
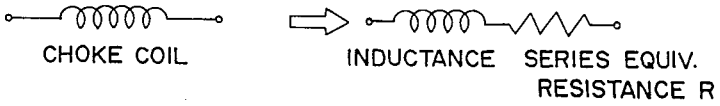
FIG. 3 is a diagram explanatory of a series equivalent circuit of a choke coil of the magnetron.

An impedance of each choke coil 19 or 20 can be equivalently represented as shown in FIG. 3. A series equivalent resistance R shown in FIG. 3 is referred to as the resistance of the choke coil.

Figure 4:
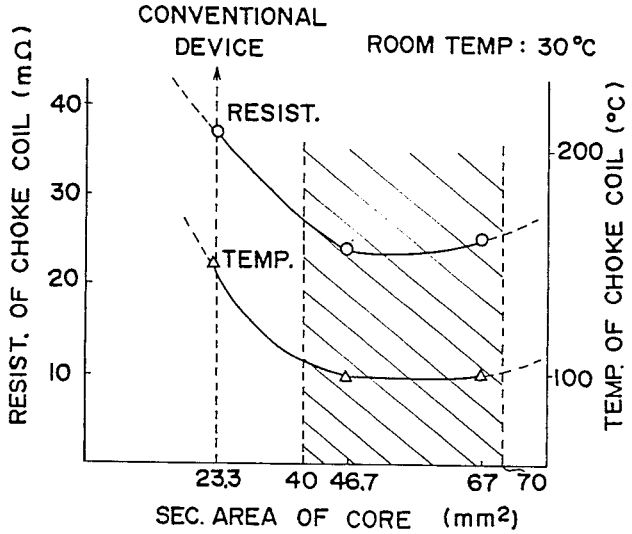
FIG. 4 is a graph showing the relationship between the resistance and temperature of the choke coil and the sectional area of a core of the choke coil.

FIG. 4 shows the change of resistance and temperature of the choke coil with the change of sectional area of the magnetic core i.e. the change of diameter thereof.

The magnetic core of the choke coil is a rod-shaped core having a length of 21 mm and is made of ferrite material frequently used in the magnetron filter, for example, material 6H3 produced by Tomita Electric Co., Ltd.. The material 6H3 has an initial permeability 80 and the Curie point below 250° C. The measurement has been executed using the frequency of 30 KHz. The number of turns of the winding having a diameter of 1.4 mm has been controlled so that the inductance value of the choke coil may become 1.7 $\mu$H during the measurement at the frequency of 30 KHz. The winding is densely formed around the rod-shaped magnetic core substantially at the central portion thereof.

According to FIG. 4, the resistance value of the choke coil having a core sectional area of 46.7 $mm^2$ is 24 milliohms. This value is approximately 35% smaller than 37 milliohms, which is the resistance value of the choke coil having a core sectional area of 23.3 $mm^2$.

When electric current of 10 A at the frequency of 30 KHz is caused to flow in the choke coil, the temperature of the choke coil having the core sectional area of 46.7 $mm^2$ rises up to 100° C. This temperature is approximately 33.3% lower than 150° C. up to which the temperature of the choke coil having the core sectional area of 23.3 $mm^2$ rises. That is to say, the reduction ratio in the temperature of the choke coil substantially coincides with that in the resistance thereof. Accordingly, it can be understood that there is a close connection between the resistance and temperature rise of the choke coil.

Figure 5:
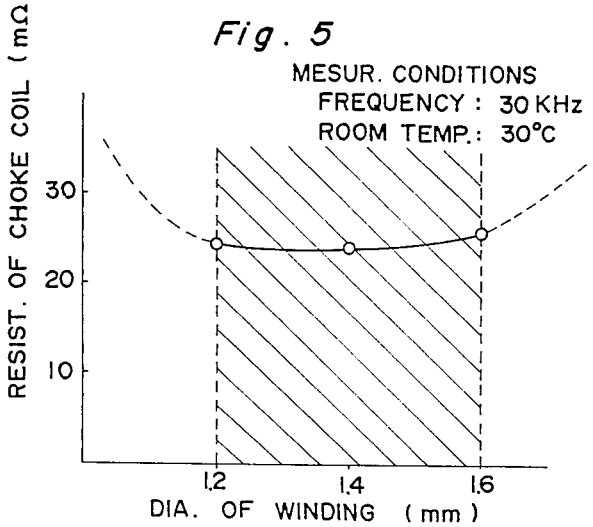
FIG. 5 is a graph showing the relationship between the resistance of the choke coil and the diameter of an electric wire wound therearound.

FIG. 5 represents the change of resistance of the choke coil with the change of diameter of the winding, using the magnetic core having the sectional area of 46.7 $mm^2$ and the length of 21 mm.

According to FIG. 5, when the diameter of the winding is between 1.2 and 1.6 mm, the resistance of the choke coil is kept substantially unchanged, thus resulting in nearly constant temperature rise thereof. Accordingly, if the choke coil is formed by the winding having a diameter between 1.2 and 1.6 mm and the magnetic code having a sectional area of 46.7 $mm^2$ and a length of 21 mm, its temperature rise can be minimized on condition that its inductance is kept unchanged.

Figure 6:
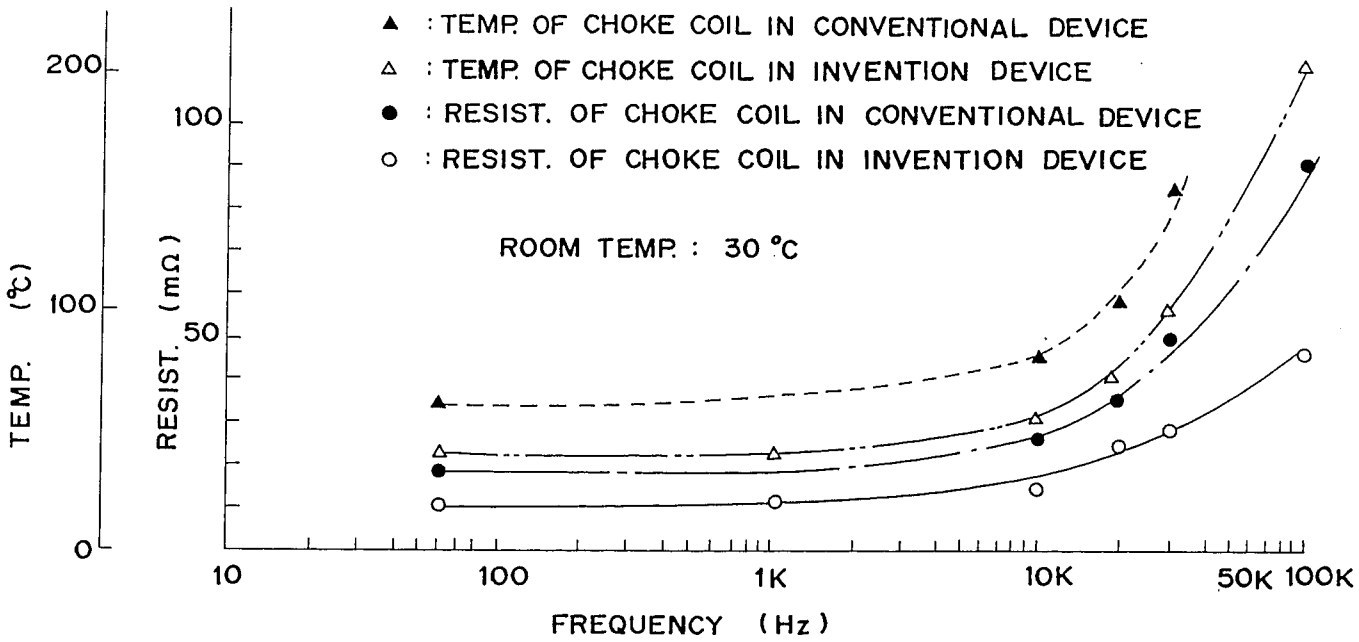
FIG. 6 is a graph showing the relationship between the resistance and temperature of the choke coil and frequency.

FIG. 6 represents the relationship between the frequency and the resistance and temperature of the choke coil both in the conventional device and in the invention device.

It is clearly shown in FIG. 6 that the temperature of the choke coil in the invention device is approximately 150° C. at the frequency of 50 KHz. In the high-frequency heating device, the temperature of a power source portion including the magnetron generally rises up to a value 10° to 20° C. higher than the room temperature due to heat generation caused by the transformer, transistor and magnetron. Accordingly, with the use of the choke coil according to the present invention, the electric wire of the grade H having the maximum allowable temperature of 180° C. can be used with safety in a certain temperature range.

It is to be noted here that the inductance value between 1.4 and 2.0 μH is a typical one which is used with the feed-through capacitor between 100 and 500 pF frequently employed as a filter with respect to a TV band.

As described above, according to the present invention, the choke coil can be restrained as low as possible in temperature rise and can be sufficiently used even at a relatively high operating frequency between 20 and approximately 50 KHz. Furthermore, the characteristic of the filter can be kept effective as well as that of the conventional filter.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A high-frequency heating device comprising:

a unilateral power source to be obtained by rectifying a commercial power source;

an inverter circuit for converting electric power supplied from said unilateral power source into high-frequency electric power at a frequency between 20 and approximately 50 KHz;

a transformer for stepping up said high-frequency electric power of said inverter circuit to high-frequency high-voltage electric power;

a magnetron biased by an output from said transformer and provided with a filter comprised of a plurality of feed-through capacitors and choke coils; and means for supplying high-frequency electric current to a heater provided in said magnetron, each of said choke coils consisting of a rod-shaped magnetic core and an electric wire wound around said magnetic core and connected at its one end to an electrode of said heater and at its other end to an electrode of said feed-through capacitors, said magnetic core having a sectional area between 40 and 70 $mm^2$, said electric wire having a diameter between 1.2 and 1.6 mm.

2. The heating device according to claim 1, wherein said means is a winding formed around said transformer.

* * * * *